US007721671B2

(12) United States Patent
Ager et al.

(10) Patent No.: US 7,721,671 B2
(45) Date of Patent: May 25, 2010

(54) BRACING FOR COLLAPSIBLE BOAT

(75) Inventors: Gavin Ronald Ager, Bibra Lake (AU); Stefano Piviali, Palmyra (AU); Edward Joseph Khoury, Bateman (AU)

(73) Assignee: QuickBoats Pty Ltd. (AU)

( * ) Notice: Subject to any disclaimer, the term of this patent is extended or adjusted under 35 U.S.C. 154(b) by 0 days.

(21) Appl. No.: 11/958,481

(22) Filed: Dec. 18, 2007

(65) Prior Publication Data

US 2008/0092795 A1 Apr. 24, 2008

Related U.S. Application Data

(63) Continuation-in-part of application No. 11/282,218, filed on Nov. 17, 2005, now Pat. No. 7,314,018.

(60) Provisional application No. 60/984,708, filed on Nov. 1, 2007.

(30) Foreign Application Priority Data

Aug. 11, 2005 (CA) ..... 2515812
Aug. 12, 2005 (AU) ..... 2005203597
Aug. 24, 2007 (AU) ..... 2007904603

(51) Int. Cl.
*B63B 7/00* (2006.01)

(52) U.S. Cl. ..... 114/354; 114/353

(58) Field of Classification Search ..... 114/343, 114/352, 353, 354, 357
See application file for complete search history.

(56) References Cited

U.S. PATENT DOCUMENTS 1,884,792 A * 10/1932 McGrath ..... 114/354
2,346,081 A 4/1944 Randrup
2,504,225 A 4/1950 Randrup
2,880,429 A 4/1959 Henry
3,032,784 A * 5/1962 Randrup ..... 114/354
3,482,368 A 12/1969 Stansbury, Jr.
3,639,933 A 2/1972 Trowbridge
3,648,309 A * 3/1972 Novakovich ..... 114/354
3,748,670 A * 7/1973 Musson ..... 114/354
4,124,910 A * 11/1978 Raymond ..... 114/354
4,250,583 A * 2/1981 Jensen ..... 114/354
4,282,616 A 8/1981 Battershill
4,697,540 A * 10/1987 Graham ..... 114/354
4,911,095 A 3/1990 Kaye
5,184,565 A 2/1993 Matthews
5,372,085 A 12/1994 Kaye
5,488,922 A 2/1996 Hinderberger
5,524,570 A 6/1996 Kaye

FOREIGN PATENT DOCUMENTS

AU 2004904559 8/2004
GB 942270 11/1963
GB 2013586 8/1979
NZ 213536 9/1985

* cited by examiner

*Primary Examiner*—Lars A Olson
(74) *Attorney, Agent, or Firm*—Bachman & LaPointe, P.C.

(57) ABSTRACT

A collapsible boat hull comprises a pair of bottom panels and a pair of side panels, connected by continuous hinges. Erection of the boat causes a fore portion of the bottom panels to curve upwards, and fore portions of the side panels to curve inwards. The boat also includes a V-shaped rear seat, which acts to transfer force and vibration from a rearwardly mounted outboard motor to the side walls of the boat. The boat is braced between its seats and the hull.

16 Claims, 14 Drawing Sheets

BRACING FOR COLLAPSIBLE BOAT

BACKGROUND OF THE INVENTION

The present invention relates to collapsible boats, such as those formed by panels hinged together. More particularly, the invention relates to a method for bracing such boats when in an erected configuration to provide stiffness and rigidity.

It is known to provide collapsible boat hulls, comprising a pair of hingedly interconnected bottom panels and a pair of side panels hinged to the bottom panels. Such boats can be collapsed and folded along the hinging edges of the panels into a substantially flat configuration for ease of transport and storage, and then erected into a suitable hull shape for use on water. Typically, collapsible boat hulls are also provided with a stern member functioning as a transom, a bow member, and seats which are mounted onto the boat hull when the boat hull is in an erected configuration. It is important that the junction between the boat hull and the bow member, and the boat hull and the stern member, are leak-proof. Provision is generally also made to mount an outboard motor on the stern member. Some collapsible boat hulls are provided with rigid stern members, while others are provided with diaphragms that can accommodate rigid panels, which rigidify and stabilise the diaphragm when an outboard motor is mounted thereon. The stress exerted on the boat hull by the outboard motor mounted on the stern members, however, has meant that it has not generally been possible to use outboard motors whose power exceeds about 4 horsepower.

In a traditional boat design, rigidity and stiffness including torsional stiffness are largely achieved by the provision of ribs extending laterally across the hull of the boat. These provide lateral support, complementing the longitudinal support provided by stringers, the hull panels and strakes in the hull and thus strengthening the hull in two dimensions. As a result, stiffness and rigidity of the hull is established, particularly in response to torsional forces.

In a collapsible boat, it has not proved possible to include ribs in the same way, although attempts have been made. As a result, many collapsible boats have a limited capacity to resist twisting as a result of torsional forces.

One method employed to provide bracing in collapsible boats is to use seats of the boat for this purpose. Such bracing is largely ineffectual, as the seat is spaced from the boat hull, and has no direct connection to panels at the base of the boat or to the transom.

A degree of torsional stiffness can be gained near a boat's transom by coupling of the transom to each of the panels. Typically, the transom of a collapsible boat is a removable member. A suitable coupling arrangement can be complex, and make assembly of the boat more difficult.

The present invention seeks to provide a means for bracing a collapsible boat which overcomes, at least in part, some of the above mentioned disadvantages.

SUMMARY OF THE INVENTION

In accordance with a first aspect of the present invention there is provided a collapsible boat hull comprising: a pair of bottom panels, each bottom panel having a first continuous hinge along an inner edge thereof and a second continuous hinge along an outer edge thereof; a pair of side panels, each side panel being connected to an adjacent bottom panel along a respective second continuous hinge; a stern member; and a seat, the seat providing a brace between the stern member and the side panels.

Preferably, the seat is V-shaped.

Advantageously, this permits force and vibration from an outboard motor mounted on the stern member to be transmitted to the side panels.

In accordance with a second aspect of the present invention there is provided a means for bracing a collapsible boat, the boat having two sides and at least one bottom panel, the means for bracing including a first member which extends between one side of the boat and the other, and at least one second member, the at least one second member extending between a bottom panel and the first member, wherein the at least one second member restricts the movement of its associated bottom panel in at least one direction. Advantageously, this assists in restricting twisting of the boat hull when subjected to torsional forces.

Typically a collapsible boat will have two bottom panels. In this case, it is preferred to have two second members, one extending from each panel.

The first member may include protrusions extending towards the bow or stern of the boat, with the second members attaching to the protrusions. The protrusions may mount over the bow or stern of the boat, for instance over the boat's transom.

The first member and the bottom panel may each have receiving means for the second member. One of the receiving means, preferably on the bottom panel, may allow for the second member to be connected to the receiving means so as to be rotatable about the receiving means. The second member may be able to hook about the other receiving means, which may be a protrusion extending from the first member.

The second member may be rigid. It may also be of adjustable length, and able to be brought into tension when connected between the respective receiving means.

The first member may be a seat. In a preferred embodiment of bracing at the stern of the boat, the first member is a rear seat extending between the two sides of the boat, the seat having protrusions extending rearwardly and mounting over the boat's transom. This allows a motor to be mounted on the transom in such a way that force and vibration are transmitted through the protrusions to the seat and thence to the boat sides. The second members are connected to the bottom panels so as to be able to rotate about their connection means, and then hook over the projections. This allows the stern of the boat to be locked together in a rigid fashion.

Alternatively, the second members may be flexible, for instance being ropes or cables. Flexible second members may be coupled to the protrusions, and be arranged to attach to the receiving means on the bottom panel by a hook-and-loop arrangement.

The second member may be a composite unit, for instance composed of first cables extending downwardly from the first member and second cables extending upwardly from the bottom panels, the first and second cables being connected by a joining means. The joining means may be adjustable, and able to provide tension to the first and second cables.

The second cables may extend from the joining means, through the receiving means, to another at least one anchoring position. The anchoring position may be at the bow of the boat.

In a preferred embodiment of bracing at the bow of the boat, the anchoring position is located on a collapsible two-piece nose cone. The nose cone includes two resilient arms which, when in an assembled configuration, form a curved prow of the boat. This allows the assembled boat to be easily manipulated from the front, and also acts to minimise damage to other boats in the event of a low-speed collision. The resilient arms may have a gap between their outer ends in the assembled configuration to allow for the passing of a rope or chain between the arms.

The nose cone has two inwardly depending portions, which when brought together provide the anchoring position. The act of bringing the second cable into tension acts on the two parts of the nose cone, bringing them together into an erected configuration. The anchoring position may be a hook over which the second cable can be looped.

The first member may be a cross bar near the bow of the boat. The first cables may connect to the first member, and also to a removable bow cover to maintain the bow cover in position. The first may alternatively be the nose cone.

BRIEF DESCRIPTION OF THE DRAWINGS

It will be convenient to further describe the invention with reference to the accompanying drawings which illustrate preferred embodiments of the bracing of the present invention. Other embodiments are possible, and consequently, the particularity of the accompanying drawings is not to be understood as superseding the generality of the preceding description of the invention. In the drawings.

DESCRIPTION OF PREFERRED EMBODIMENT(S)

Figure 1:
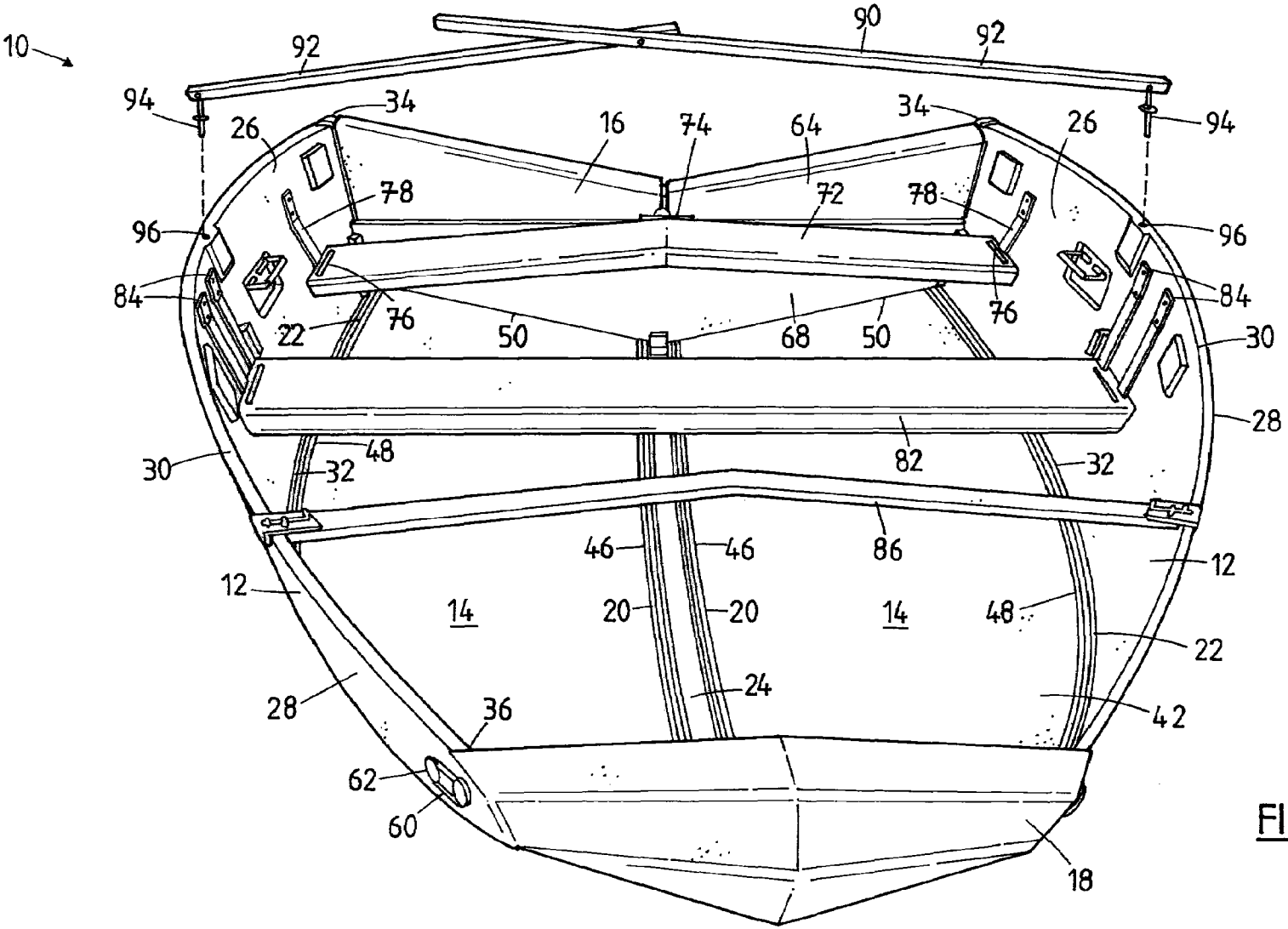
FIG. 1 is an upper perspective view of a collapsible boat hull in accordance with a first embodiment of the present invention, shown in an erected configuration.

Referring to FIGS. 1 to 7, there is shown a collapsible boat hull 10 comprising a pair of side panels 12, a pair of bottom panels 14, a stern member 16, and a bow member 18. Each bottom panel 14 has a first continuous hinge 20 along an inner edge thereof, and a second continuous hinge 22 along an outer edge thereof. In the embodiment of the drawings, each of the first continuous hinges 20 is connected to respective first and second sides of a centrally disposed keel member 24. In an alternative keel-less embodiment of the invention, the two bottom panels 14 are connected along a single common first continuous hinge 20.

Figure 2:
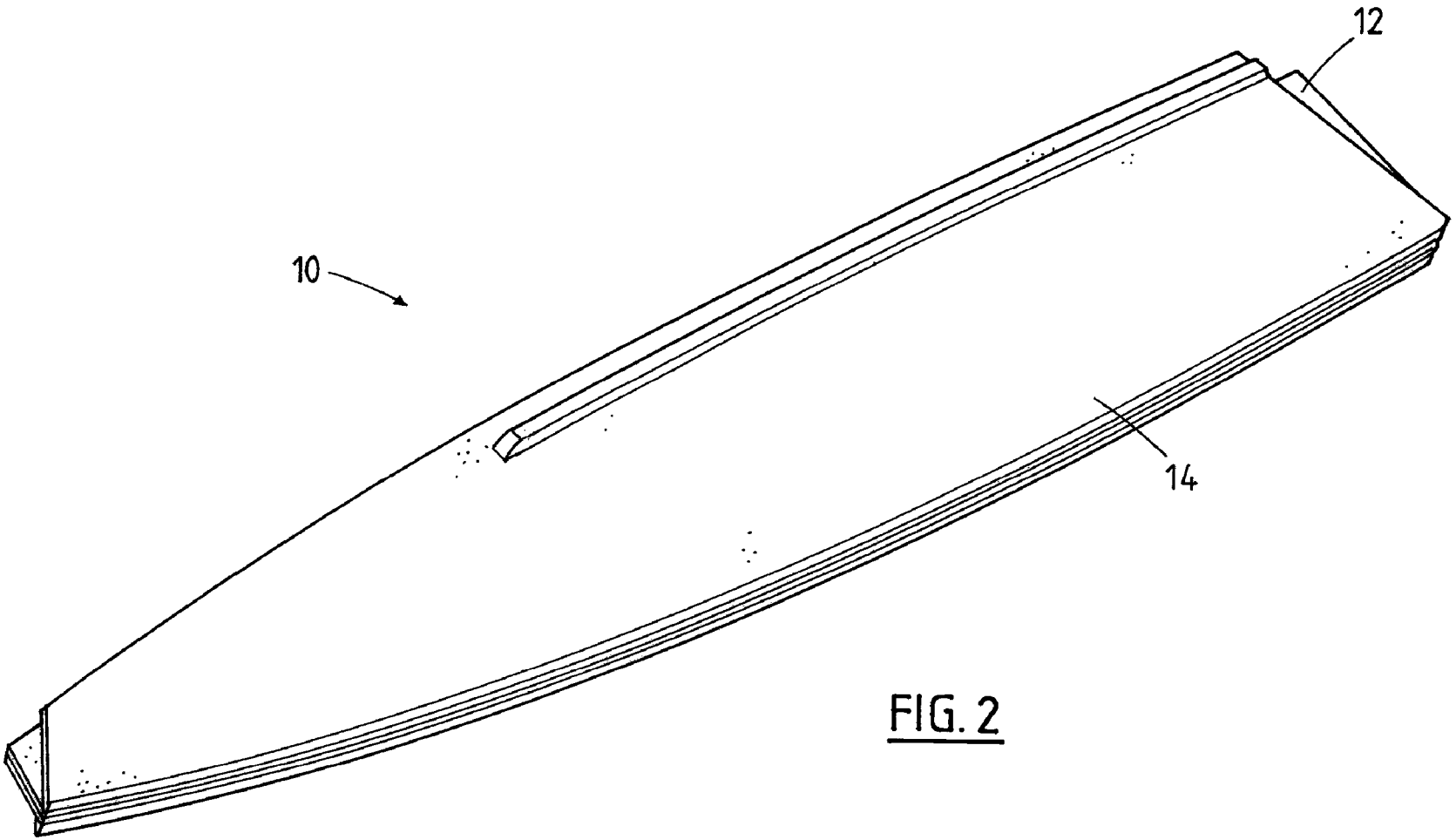
FIG. 2 is a side view of the collapsible boat hull of FIG. 1, shown in a collapsed and folded configuration.
Figure 3:
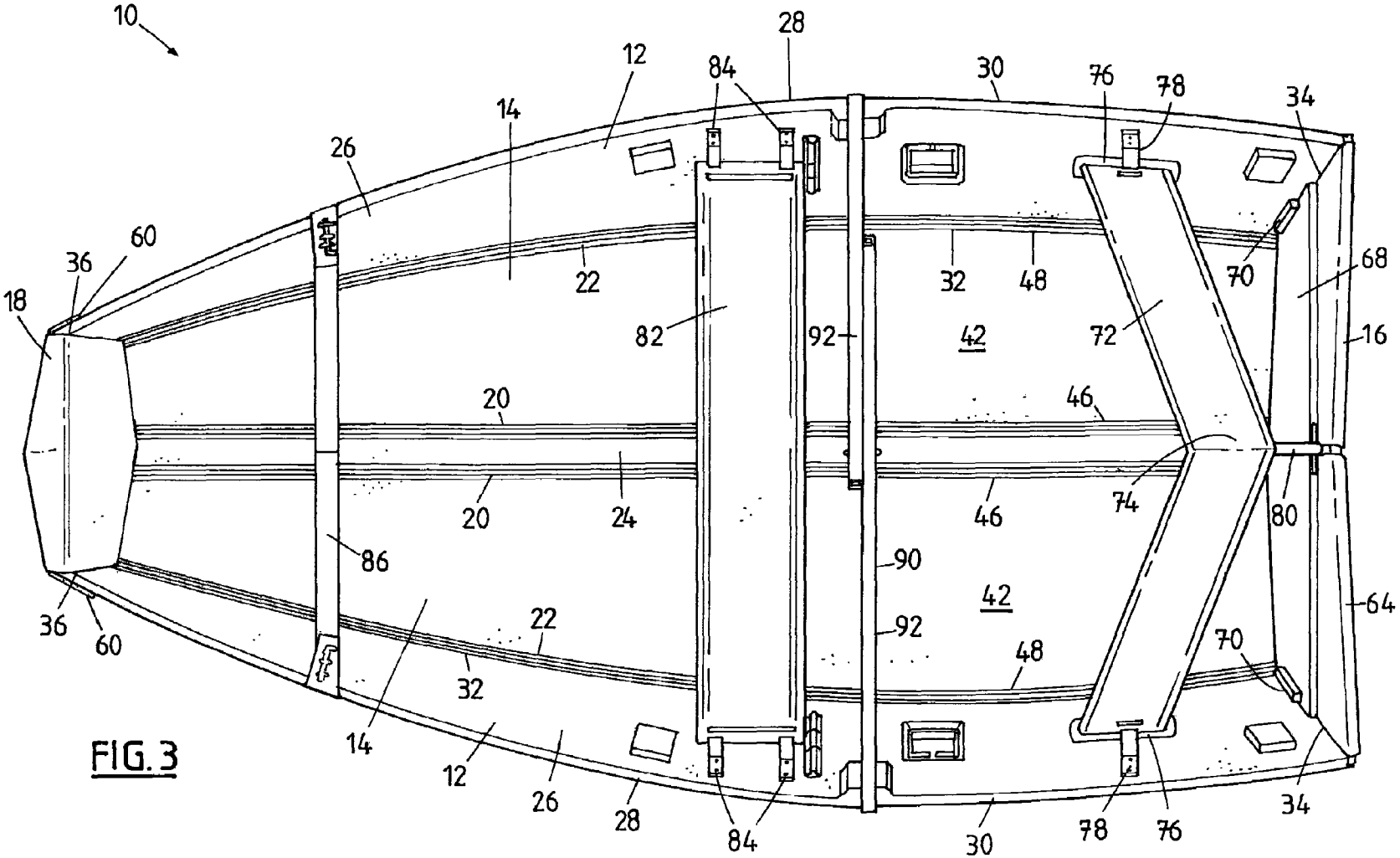
FIG. 3 is a top plan view of the collapsible boat hull of FIG. 1.

Each bottom panel 14 is connected to a corresponding side panel 12 along its second continuous hinge member 22. Spines of each of the first and second continuous hinge members 20,22 have resilient flexibility along respective longitudinal and transverse planes thereof, thereby facilitating the bottom and side panels 14, 12 to be collapsed and folded from a first position wherein the boat hull 10 is in an erected configuration shown in FIG. 1 to a second position wherein the boat hull 10 is in a collapsed and folded state as shown in FIG. 2.

The side and bottom panels 12, 14 are made from stiff, lightweight materials that have high tensile strength and resist abrasion. Typically, the side and bottom panels 12, 14 are made from a composite fibreglass material. Alternatively, the side and bottom panels 12, 14 may be made from a marine grade aluminium honeycomb closed cell composite panel of approximately 10 mm width, such as a 5052 HR A1 composite panel, or a heavy duty alternative such as kevlar and polypropylene. These may be a combination of composite or honeycomb structures.

Preferably, the rigidity of the material is such that when the boat hull 10 is in the erected configuration, the boat hull 10 is almost rigid and rides very well in the water.

Further, the side and bottom panels 12, 14 could also be made from a rigid and/or composite aluminium, plywood or plastics materials, with high tensile strength and abrasion resistivity.

The keel member 24 is substantially flat and elongate. It is arranged to be longitudinally aligned along the keel line of the boat hull 10. The keel member 24 may be made from any suitable rigid or semi-rigid material including metal, plastics or wood having sufficient flexibility from a mid-ship line 1 (see FIG. 7) forward to the aft of the boat hull 10 to form a compound curve toward the bow increasing its curvature and tension to partly form a unique bow shape while the boat hull 10 is being erected.

Figure 7:
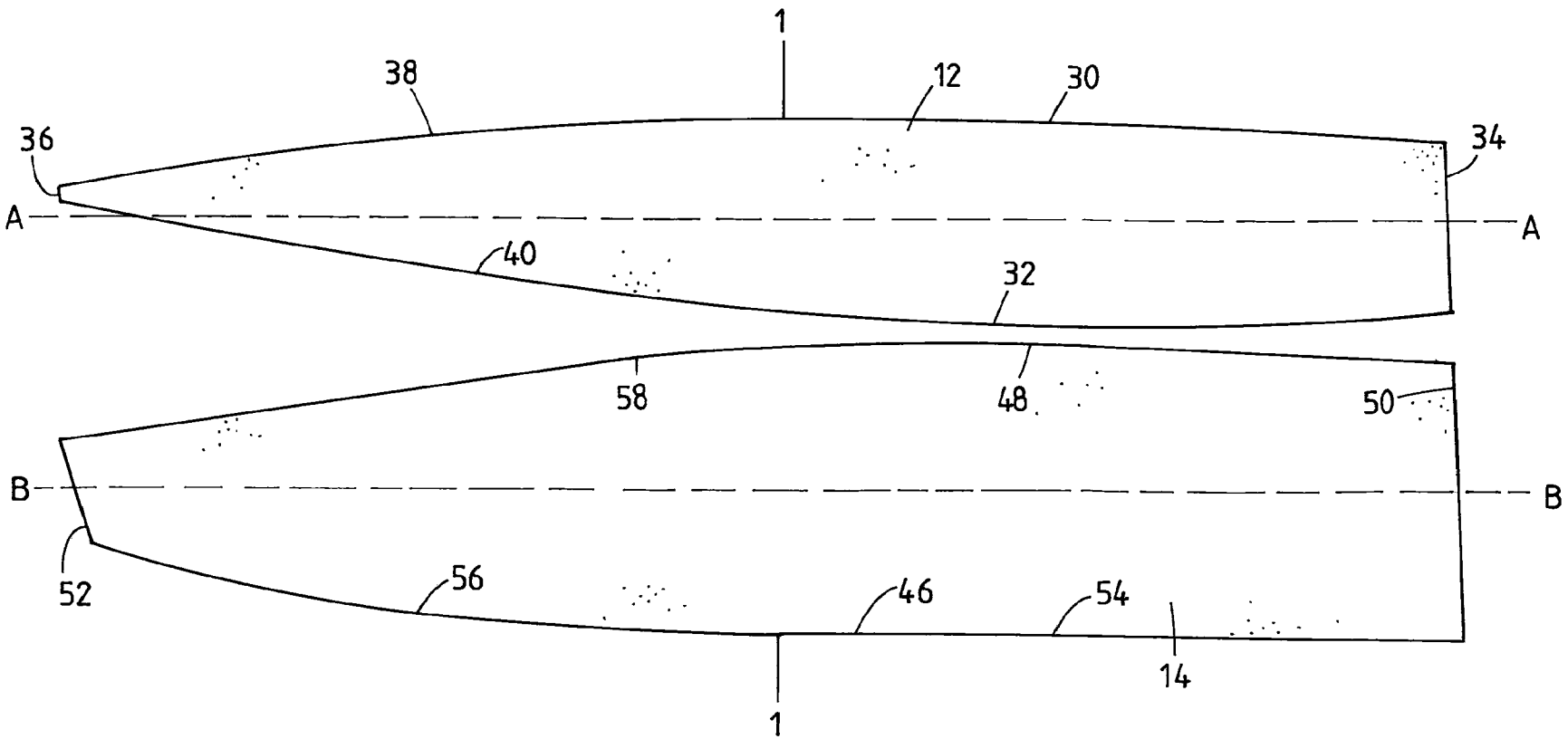
FIG. 7 is an exploded diagrammatic view of a side panel and a bottom panel of the collapsible boat hull of FIG. 1.
Figure 8:
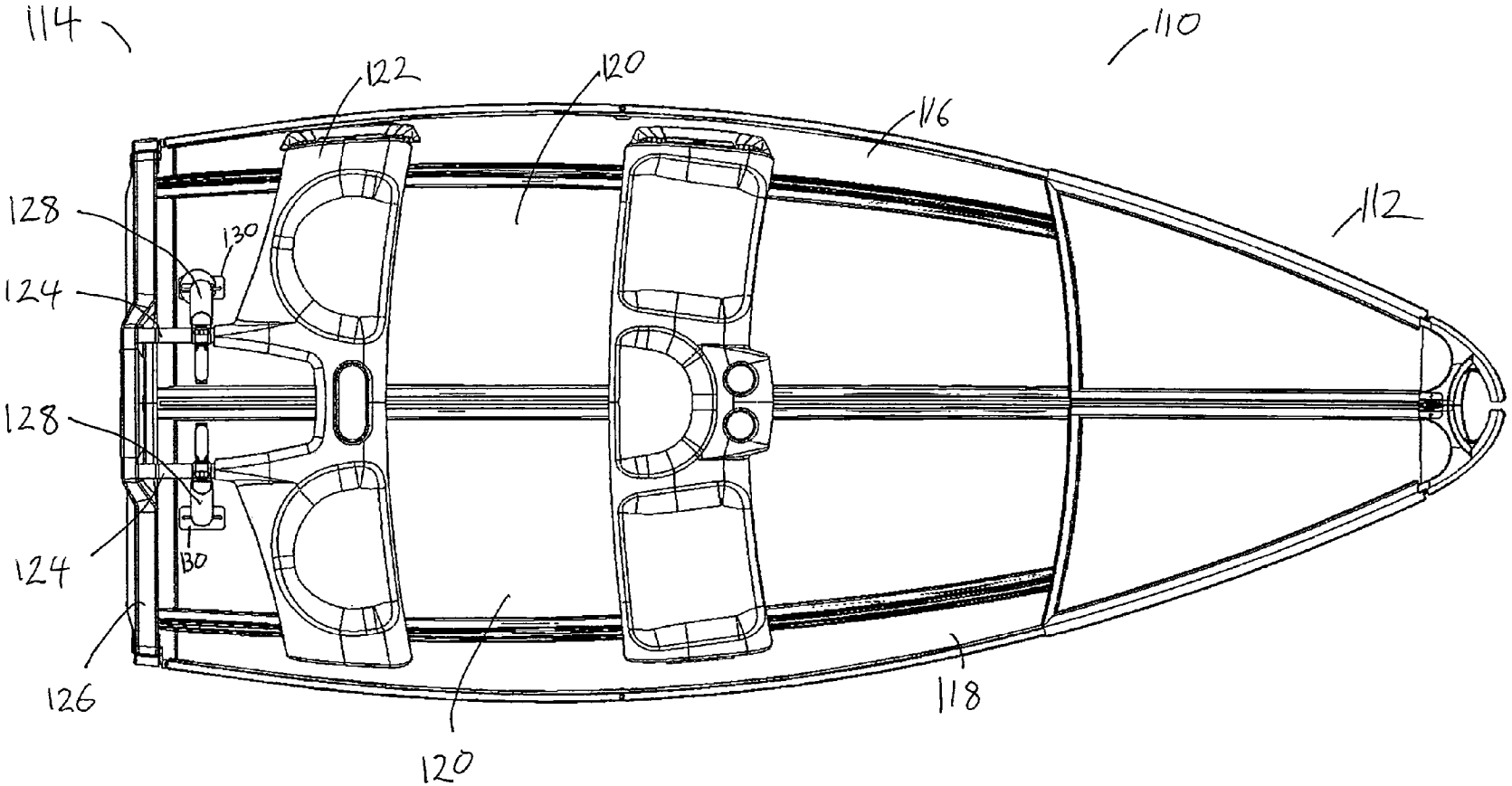
FIG. 8 is a plan view of a boat having bracing in accordance with a second embodiment of the present invention.
Figures 9A, 9B:
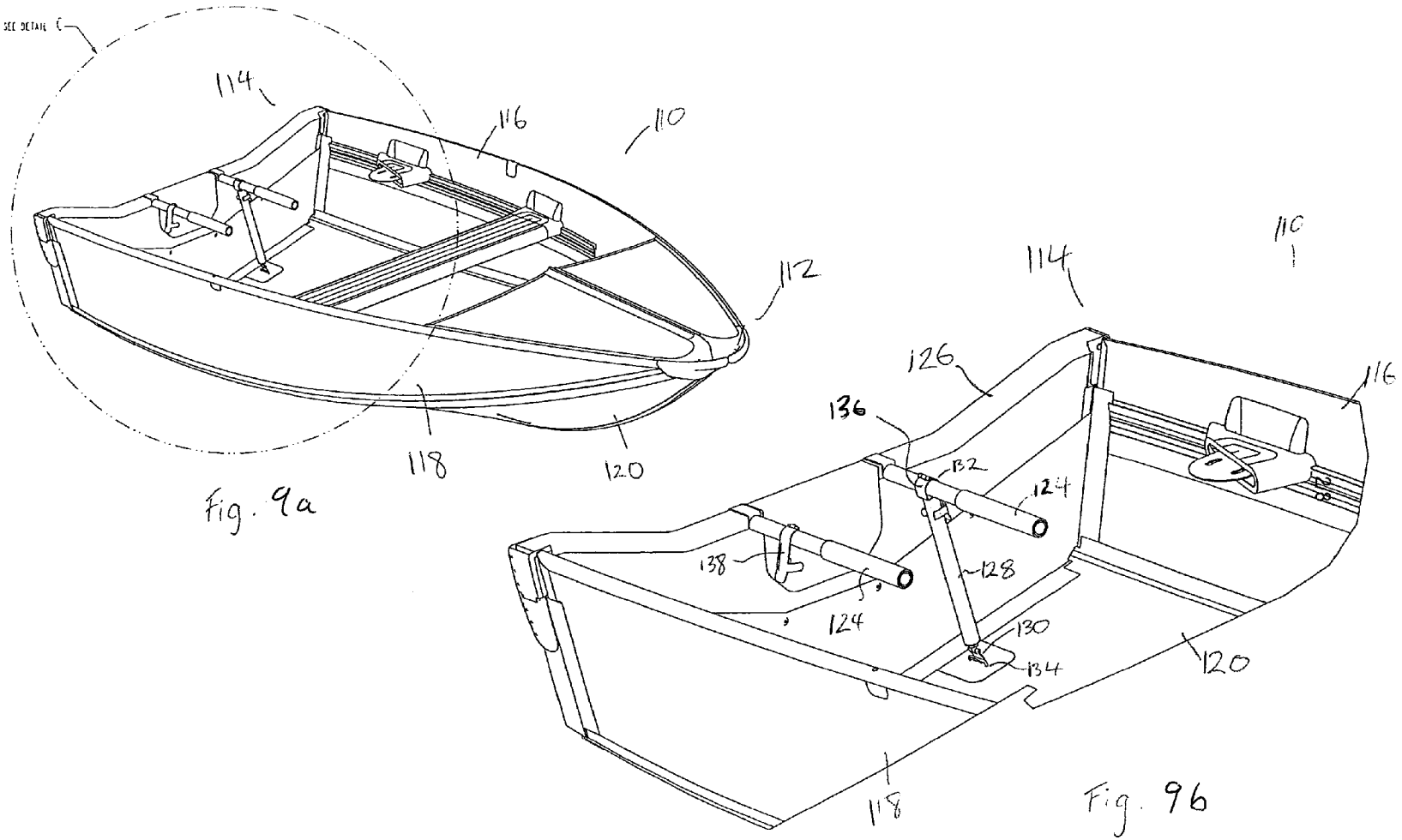
FIG. 9*a* is a partially cut away view of a boat having bracing in accordance with a third embodiment of the invention.
FIG. 9*b* is an enlarged cut away view of the stern of the boat of FIG. 9*a;*

Each side panel 12, shown in isolation in FIG. 7, is substantially flat and elongate having an inner surface 26, an outer surface 28, a gunwale edge 30, an inner edge 32, an aft edge 34, and a fore edge 36. The gunwale edge 30 of the side panel 12 is shaped to define a first continuous convex curve 38 descending from the aft edge 34 to the fore edge 36, as shown in FIG. 7. A descent of the first continuous convex curve 38 becomes steeper from about the mid-ship line 1 towards the fore edge 36.

The inner edge 32 of the side panel 12 is shaped to define a second continuous convex curve 40 descending from the aft edge 34 to the fore edge 36, as shown in FIG. 7. A descent of the second continuous convex curve 40 becomes steeper from about the mid-ship line 1 towards the fore edge 36. The descent of the second continuous convex curve 40 is greater than the descent of the first continuous convex curve 38 such that the side panel 12 is asymmetrically disposed about a central longitudinal plane A-A of the side panel 12. Accordingly, the fore edge 36 is shorter in length than the aft edge 34, and the fore edge 36 is disposed asymmetrically about the central longitudinal plane A-A towards to the gunwale edge 30.

Typically the aft edge 34 is disposed at substantially right angles to the gunwale edge 30 and the inner edge 32. However, the angle may vary by as much as ±20°. The aft edge 34 is substantially symmetrically disposed about the central longitudinal plane A-A of the side panel 12.

The depth of the side panel 12 may be varied from the gunwale edge 30.

Each bottom panel 14, shown in isolation in FIG. 7, is substantially flat and elongate having an inner surface 42, an outer surface 44, an inner edge 46, an outer edge 48, an aft edge 50, and a fore edge 52.

The inner edge 46 of the bottom panel 14 is shaped to define a substantially straight longitudinally disposed portion 54 between the aft edge 50 and about the mid-ship line 1, and a third continuous convex curve 56 descending from about the mid-ship line 1 to the fore edge 52, as shown in FIG. 7. The outer edge 48 of the bottom panel 14 is shaped to define a fourth continuous convex curve 58 which flares outwardly from the aft edge 50, reaching its maximum outward extent at a point rearwardly disposed of the mid-ship line 1, then descends from about the mid-ship line 1 to the fore edge 52, as shown in FIG. 7. The difference in shapes of the inner edge 46 and outer edge 48 mean that the bottom panel 14 is asymmetrically disposed about a central longitudinal plane B-B of the bottom panel 14.

Accordingly, the fore edge 52 is shorter in length than the aft edge 50. Typically the fore edge 52 is rearwardly inclined from the outer edge 48 by about 20°, although this may vary by ±20°.

Typically the aft edge 50 is disposed at substantially right angles to the inner edge 46 and the outer edge 48. The aft edge 50 is substantially symmetrically disposed about the central longitudinal plane B-B of the bottom panel 14.

The width of the bottom panel 14 may be varied from the inner edge 46.

It is envisaged that the length of the collapsible boat hull 10 of the present invention could vary from about 2 m to 8 m in length. The shape of the side and bottom panels 12, 14 are adapted such that when the collapsible boat hull 10 is in the erected configuration, the side panels 12 bend inwardly and the bottom panels 14 bend upwardly such that the stern of the boat hull 10 is raised above the stern of the boat hull 10, as in a conventional small boat hull. Accordingly, the collapsible boat hull 10 handles very well in the water when it is in the erected configuration.

Figure 4:
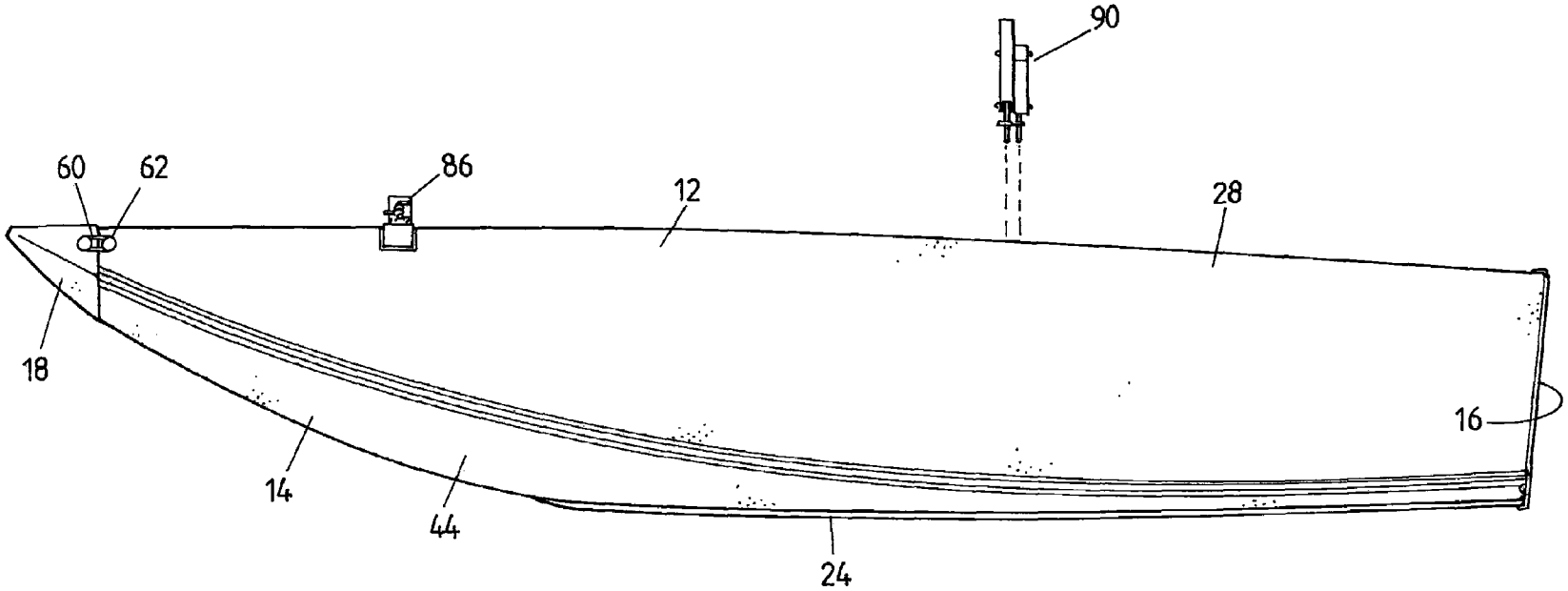
FIG. 4 is a side elevation view of the collapsible boat hull of FIG. 1.
Figure 5:
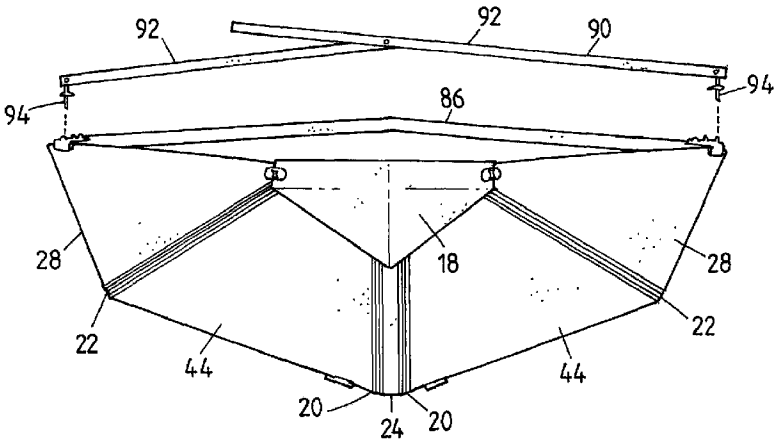
FIG. 5 is a front elevation view of the collapsible boat hull of FIG. 1.
Figure 6:
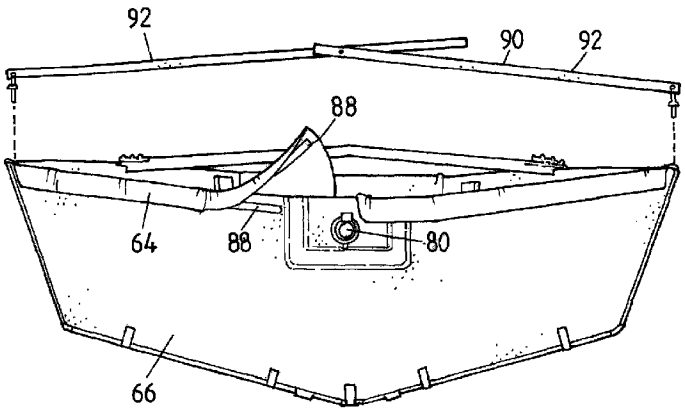
FIG. 6 is a rear elevation view of the collapsible boat of FIG. 1.

The side and bottom panels 12, 14 are shaped such that as the boat hull 10 is opened from its folded configuration, each side panel 12 provides a tensile force to its corresponding bottom panel 14 and vice versa. This tensile force causes portions of the bottom panels 14 from about the mid-ship line 1 to the aft edges 46 thereof to be directed upwardly in a continuous curve, as shown in FIG. 4, and respective portions of the side panels 12 from about the mid-ship line 1 to the aft edge 34 thereof to form a concave curvature to define the sides of the boat hull 10. In this way, the boat hull 10 is afforded a conventional shape, rather than the flat-bottomed hull or variations of cathedral designs and gull wing designs generally available in prior art collapsible boat hulls.

The bottom panels 14 are interconnected to the opposing sides of the keel member 24 along the whole length of the bottom panels' 14 inner edges 42 by the pair of first continuous hinges 20. The wings of the first continuous hinges 20 are fastened to the outer surface 44 of the bottom panels 14 and the opposing sides of the keel member 24 by suitable fastening means such as rivets or screws, together with an adhesive/sealant. The outer edge 48 of each bottom panel 14 is interconnected along its whole length to the inner edge 32 of a corresponding side panel 12 by a second continuous hinge 22. The wings of each second continuous hinge 22 are fastened to respective outer surfaces 44, of corresponding bottom and side panels 14, 12 with suitable fastening means such as rivets or screws, together with an adhesive/sealant. The first and second continuous hinges 20, 22 are made from a plastics material, the spines thereof being typically a plasticised membrane of a co-polymer material and the wings thereof being typically a PVC material which provide a water-tight seal along the length of each of the first and second continuous hinges 20, 22.

The bow member 18 is shaped to substantially cap a space defined by the fore edges 36, 52 of the side and bottom panels 12, 14 and the keel member 24 when the boat hull 10 is in the erected configuration. The bow member 18 is generally rigid and can be formed as an integral member from a moldable material such as fibreglass or suitable plastics material. Alternatively, it can be formed as a frame covered with waterproof fabric membranes, such as canvas, sailcloth, or vinyl fabrics such as RipStop™.

The bow member 18 can be provided with a sealing means to provide a waterproof seal between the bow member 18 and the fore edges 36, 52 of the side and bottom panels 12, 14 and the keel member 24 when the bow member 18 is capped therearound.

Generally, the bow member 18 is releasably fastened to the boat hull 10 by means of resilient tensioning straps 60 or clips secured to receiving means 62 provided on an outer surface 28 of the side panels 12.

The stern member 16 is shaped to substantially fit a space defined by the aft edges 34, 50 of the side and bottom panels 12, 14 and the keel member 24 when the boat hull 10 is in the erected configuration. In a preferred embodiment of the invention, the stern member 16 comprises a membrane 64 which provides a waterproof seal across the aft edges 34, 50 of the side and bottom panels 12, 14, and a removable, rigid transom member 66 which locates outside the membrane 64 when the boat hull 10 is in the erected configuration.

The membrane 64 is preferably constructed of strong, flexible or semi rigid materials such as vinyl or suitable plastics such as polypropylene.

The transom member 66 may be shaped and adapted for mounting of short or long shaft outboard motors thereon in accordance with well known principles.

The stern member 16 further includes a removable supporting member 68 located internally of the membrane 64. Each of the side panels 12 includes a guide 70 located adjacent the aft edge 34. The supporting member is held, in use, between the guides 70 and the membrane 64 and provides additional rigidity and protection to the membrane 64.

The boat hull 10 is provided with a detachable rigid V-shaped seat 72 disposed adjacent to the stern member 16 when the boat hull 10 is in the erected configuration, with an apex 74 of the V-shaped seat 72 is rearwardly disposed relative to respective free ends 76 of the V-shaped seat 72. The free ends 76 of the V-shaped seat member 72 are engaged, in use, by locking members 78 located on the inner surfaces 26 of the side panels 12.

Preferably, the locking members 78 are spring loaded, and cooperate with catches adjacent the free ends 76 of the V-shaped seat 72 when the V-shaped seat 72 is in a desired location.

The angle of the apex 74 is preferably about 120°, although may range from an acute angle through to a straight seat (ie an angle of 180°). Accordingly, the length of the V-shaped seat 72 will vary according to the angle of the apex such that the free ends 76 of the V-shaped seat 72 can be engaged to respective side panels 12 of the boat hull 10. The apex 74 of the V-shaped seat 72 can be spaced as much as 30% of the length of the boat hull 10 from the stern member 16. Alternatively, the apex 74 can be integral with the stern member 16. Typically, the apex 74 is provided with a rearwardly extending longitudinal strut 80 provided with suitable fastening means to facilitate interconnecting the stern member 16 and the apex 74 of the V-shaped seat 72.

Accordingly, the V-shaped seat 72 acts as a brace to readily transfer the force and vibration of an outboard motor, when the outboard motor is mounted on the stern member 16, to the side panels 12 of the boat hull 10. In this way, an outboard motor of greater than 4 horsepower can be readily mounted on the stern member 16 and used to its full capacity without destabilising the transom member 66, affecting the integrity of the boat hull 10, or substantially diminishing the quality of handling of the boat hull 10 in the water.

The V-shaped seat 72 is typically mounted midway up the side panels 12, but may be positioned anywhere between a location within about 20% of the inner edge 32 and a location adjacent a gunwale line of the boat hull 10.

Advantageously, the V-shaped seat 72 has an ergonomic design that affords more efficient use of available space in the boat hull 10.

The boat hull 10 is also provided with a detachable second seat 82 comprising an elongate member transversely disposed between the side panels 12 when the boat hull 10 is in the erected configuration. The second seat 82 is generally positioned substantially on a mid-ship line of the boat hull 10, but it may be positioned at a location at or between about 20% of the length of the boat hull 10 fore or aft of the mid-ship line.

The second seat 82 is typically mounted midway up the side panels 12, but may be positioned anywhere between a location within about 20% of the inner edge 32 and a location adjacent a gunwale line of the boat hull 10.

Outer ends of the second seat 82 are engaged, in use, by locking members 84 located on the inner surfaces 26 of the side panels 12. Preferably, the locking members 84 are spring loaded, and cooperate with catches adjacent the outer ends of the second seat 82 when the second seat 82 is in a desired location.

Typically the transom member 66, the V-shaped seat 72 and the second seat 82 can be made from a rigid lightweight material including, but not limited to, composite materials, fibre glass, aluminium, plywood, rigid PVC, and rigid plastics materials.

Although in this embodiment of the invention the V-shaped seat 72 and the second seat 82 are engaged by locking members 78, 84*s*, the invention envisages other fastening means which may be used. Suitable fastening means include, but are not limited to, latches and barrel bolts, stainless steel or metallic alloy male/female receptors, self latching/locking devices, and known locking devices that can be manually or automatically operated.

The collapsible boat hull 10 further includes a V-shaped forward bar 86 which fastens at opposed ends thereof to gunwale edges 30 between the fore edges 52 and the second seat 82. The forward bar 86 can support a flexible spray deck if desired.

The collapsible boat hull 10 may optionally be provided with detachable clamp-on rollicks disposed on the gunwale line, and/or a detachable fore deck formed from flexible materials, such as mesh, vinyl, sail cloth or plastics materials to conveniently hold life jackets, safety equipment, fishing equipment, and the like.

Alternatively, the collapsible boat hull may have a rigid foredeck, constructed of material such as fibreglass, alloy, plywood or plastics. The rigid foredeck may be removable, and is preferably foldable for easing stowing.

In the collapsed and folded state, the bottom and side panels 14, 12 are substantially disposed contiguously upon one another as shown in FIG. 2. In the collapsed and folded state, the bottom and side panels 14, 12 may be readily inserted into a carrier bag shaped to accommodate the collapsed and folded boat hull 10, and transported on or in a marine or land vehicle.

In use, from the collapsed and folded state, the bottom and side panels 14, 12 and the keel member 24 can be readily opened and assembled to the open configuration. In order to assist with this operation, a separating member 90 may be employed.

The separating member 90 comprised two elongate members 92 hingedly connected, with pins 94 extending laterally from outer ends thereof. The pins 94 are sized to located within corresponding apertures 96 in the gunwale edges 30. A downward force applied to one of the elongate members 92 causes the pins 94 to move apart, thus forcing the side panels 12 into their erected configuration.

The bow member 18 is then capped around the space defined by the fore edges 36, 52 of the side and bottom panels 12, 14 and the keel member 24, and secured therearound by securing tensioning straps 60 from the bow member 18 around receiving means 62, or alternately by the use of latches.

The transom member 66 is also fitted into the space defined by the aft edges 34, 50 of the side and bottom panels 12, 14 and the keel member 24, outside the membrane 64. The membrane 64 may be looped over the transom member 66 and secured by releasable means such as hook and loop fasteners 88.

Guide means may be used to facilitate attachment of the second seat 82 and the V-shaped seat 72 to the side panels 12 and the transom member 66 respectively by engaging the fastening means provided for that purpose.

Once these members, together with the forward bar 86, are in place the separating member 90 may be removed.

Optionally, once the boat hull 10 is erected the outboard motor may also be mounted on the stern member 16. Advantageously, the ready erection of the boat hull 10 in its erected configuration can be achieved in most locations, including shallow water.

Referring to FIGS. 8 to 14, there is shown a collapsible boat 110 having a bow 112 and a stern 114. The collapsible boat 110 is formed according to the method described above. The boat 110 has two side panels: a port panel 116 and a starboard panel 118; and two bottom panels 120.

The boat 110 has bracing means at both the bow 112 and the stern 114. The bracing means of the stern 114 is in accordance with one embodiment of the present invention, and will be described first.

The stern 114 includes a first member in the form of a rear seat 122. The rear seat 122 extends between the port panel 116 and the starboard panel 118, and is rigidly attached to each of the side panels 116, 118 using a releasable connection means.

The rear seat 122 has two protrusions in the form of longitudinal rods 124 extending away from the seat 122 towards the stern 114. The rods 124 mount over a transom 126 of the boat 110. The arrangement is such that, in use, force and vibration from an outboard motor mounted on the transom 126 can be transmitted through the rods 124 and seat 122 to the side panels 116, 118. This is in contrast to previous collapsible boats where the force and vibration is transferred to the boat hull through the transom 126.

Second members in the form of rigid bracing rods 128 extend, in use, between each of the bottom panels 120 and a respective longitudinal rod 124. A bracing rod 128 can be seen clearly in FIGS. 9*a* and 9*b*.

Each bracing rod 128 has a first connection means 130 for connection to the bottom panel 120 and a second connection means 132 for connection to the longitudinal rod 124.

The first connection means 130 is substantially in the form of a hook, and is arranged to engage with a first receiving means 134 located on the bottom panel 120. The first receiving means 134 is formed by a longitudinally extending bar above the panel 120. When the hook 130 is engaged around the bar 134, the bracing rod 128 is able to rotate about the bar 134 in a substantially transversely aligned, substantially vertical plane.

The second connection means 132 includes a hinged locking portion 136. The hinged locking portion 136 is moveable between an open configuration and a closed configuration. When the locking portion 136 is in the open configuration, the bracing rod 128 can be freely rotated about the first receiving means 134, from a position of being prone on the bottom panel 120 to a position where an upper end of the bracing rod 128 is resting against the longitudinal rod 124. The hinged locking portion 136 can then be hooked over the longitudinal rod 124 and secured in position, preventing relative movement of the bracing rod 128 and the longitudinal rod 124. It will be appreciated that the longitudinal rod 124 is acting as a second receiving means, for receiving the second connection means 132.

The bracing rod 128 may also include tensioning means 138. The tensioning means may be operable when the locking portion 136 is secured over the longitudinal rod 124, in order to slightly reduce the length of the bracing rod 128 in order to bring it into tension. It will be appreciated that, once the bracing rod 128 is hooked onto the first receiving means 134, locked onto the longitudinal rod 124, and brought into tension, the bottom panel will be restricted from movement relative to the seat 122, at least from movement away from the seat 122. It will also be appreciated that the tension in the bracing rods 128 will be transmitted through the longitudinal rods 124 and the bottom panels 120 to provide a compressive force on the transom 126. This acts to lock or clamp the transom in position, and prevents relative movement of the transom particularly in a vertical direction.

The bracing rod 128 may also be adjustable in length, for instance using an internal screw thread arrangement.

When both bracing rods 128 are connected and in tension, a 'box' force distribution is achieved at the stern 114 of the boat 110. The stern is thus rigidly locked together. Any torsional force applied to the stern 114 of the boat 110 will act to twist the hull. Any twisting of the hull would cause lengthening of at least one of the bracing rods 128. The tension of the bracing rods 128 thus acts to prestress them, allowing them to resist the applied forces and restrict twisting of the hull. This in turn increases the rigidity and stiffness of the boat 110 overall.

Figure 10A:
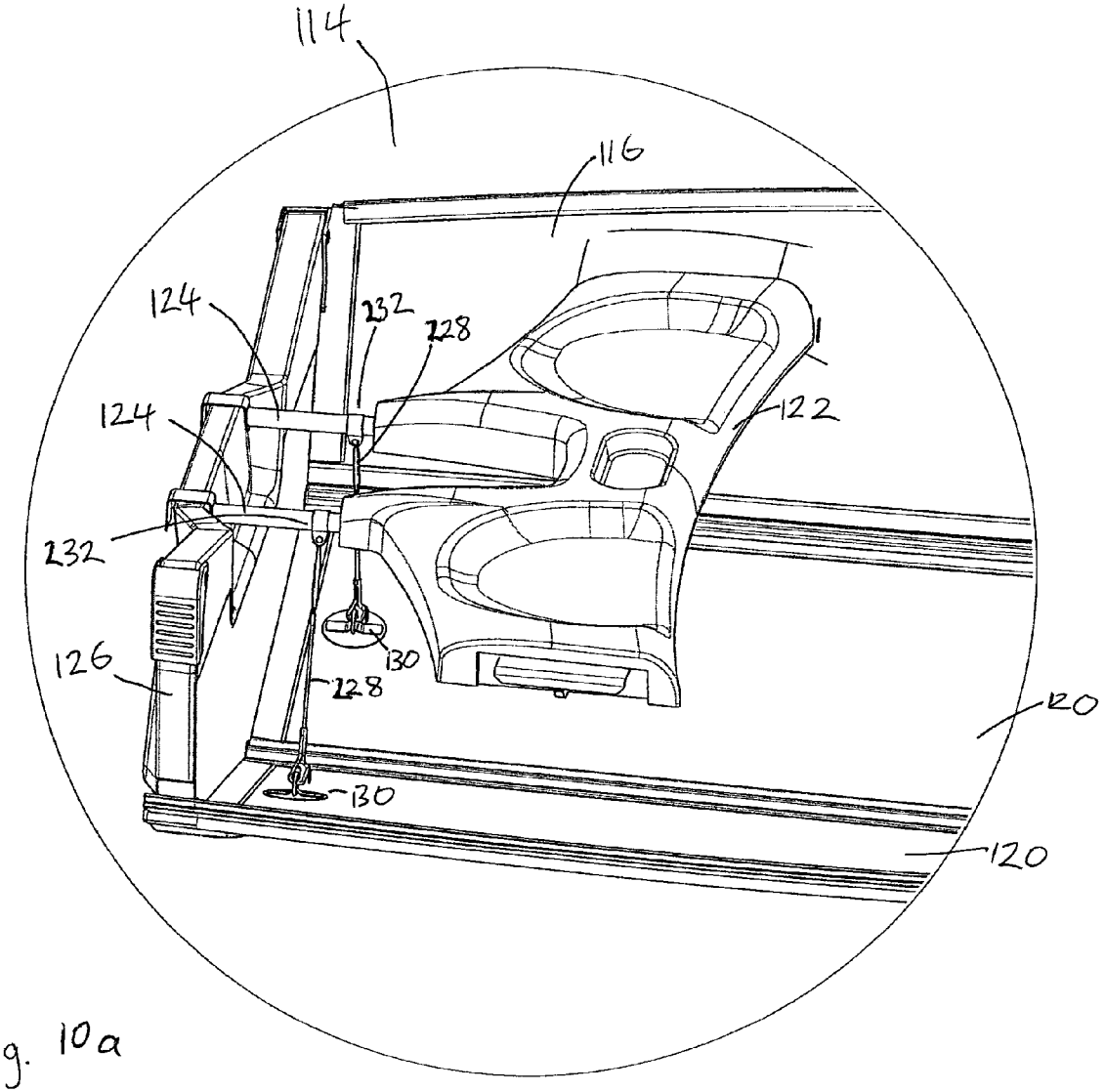
FIG. 10*a* is a partially cut away view of a portion of a boat having bracing in accordance with a fourth embodiment of the invention.
Figure 10B:
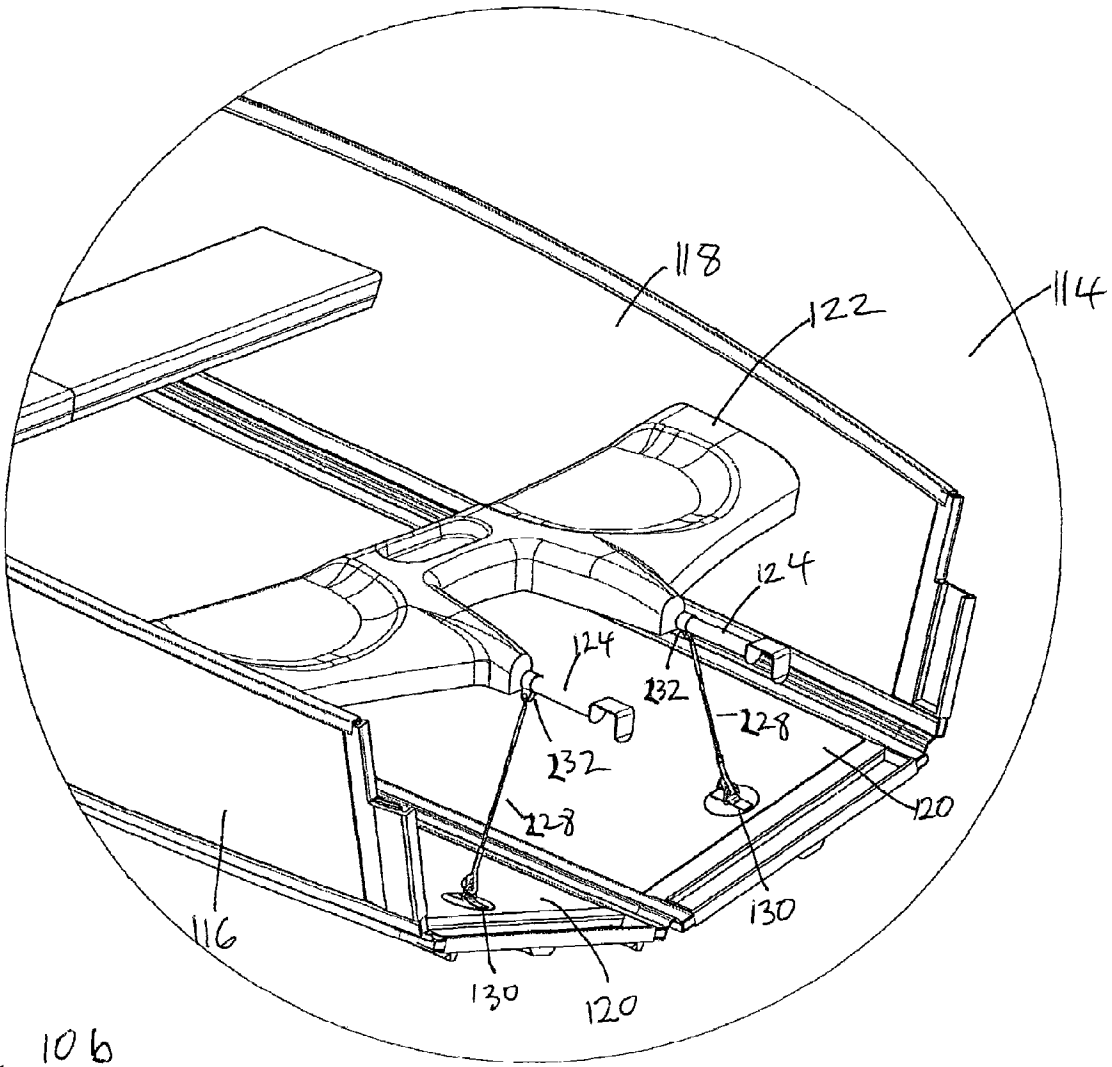
FIG. 10*b* is an alternative cut away view of a portion of the boat of FIG. 10*a;*

FIGS. 10*a* and 10*b* show bracing means at the stern 114 in accordance with a further embodiment of the invention. In this embodiment, the second members are in the form of flexible cables 228. Each cable 228 is connected to a longitudinal rod 124 by a second connection means in the form of a sleeve coupling 232. The cables 228 are connected to the bottom panels 120 by a hook-and-loop arrangement with the first connection means 130.

Preferably, the cables 228 include provision for tensioning during use.

Figure 11:
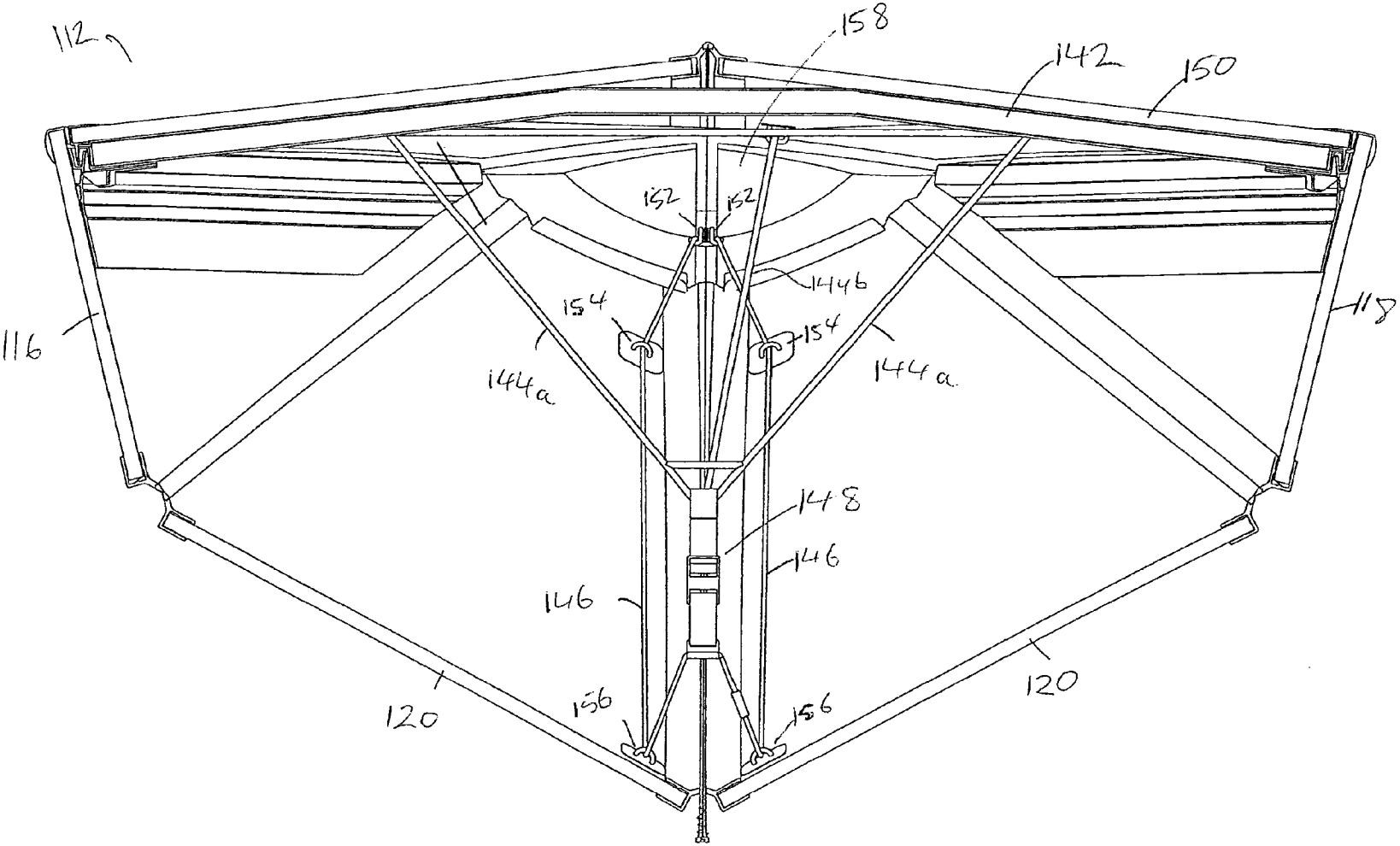
FIG. 11 is a cross sectional view of the bow of the boat of FIG. 8, showing bracing in accordance with a fifth embodiment of the invention.
Figure 12:
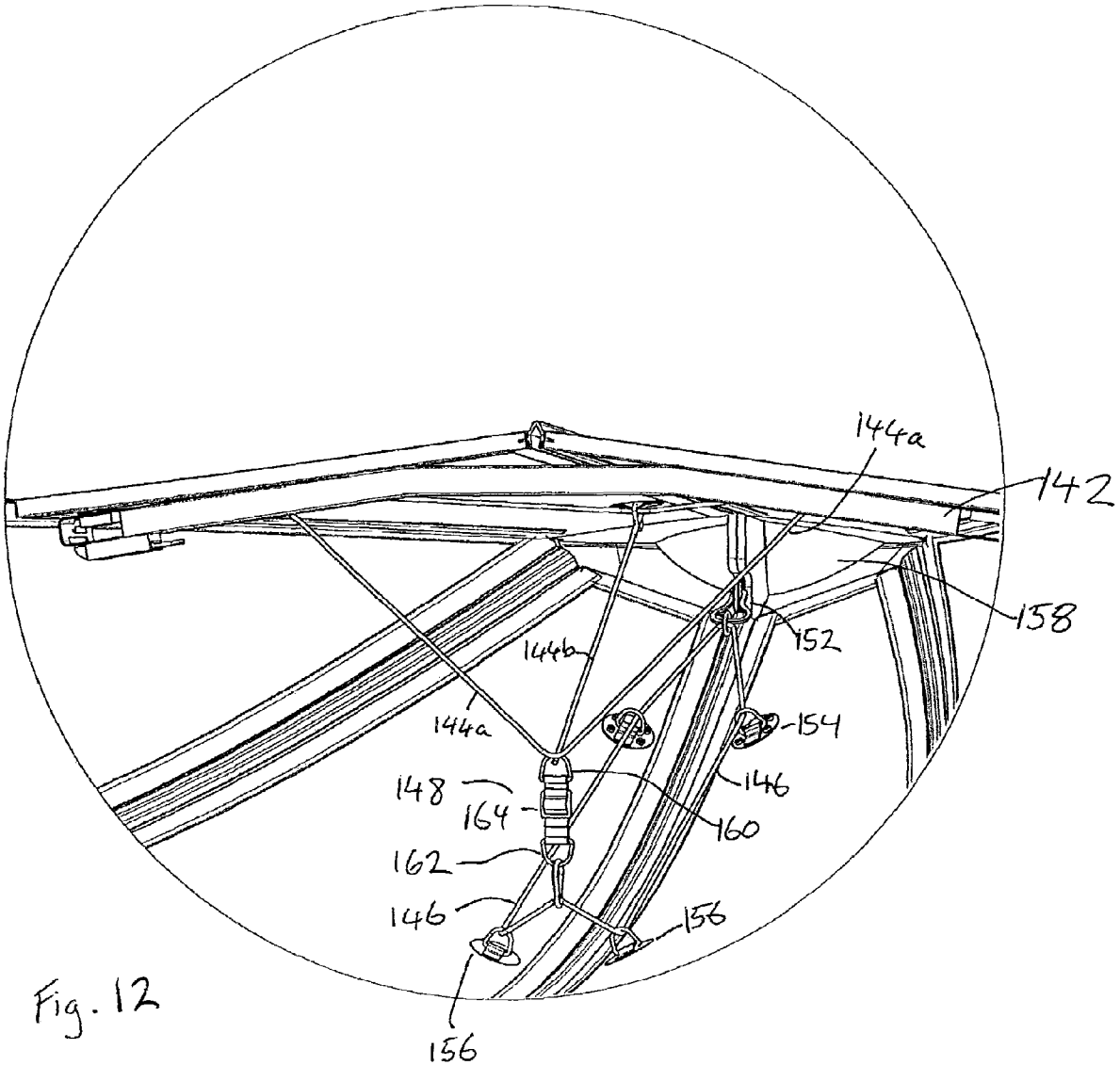
FIG. 12 is a cut away view of the bow of the boat of FIG. 11.
Figure 13:
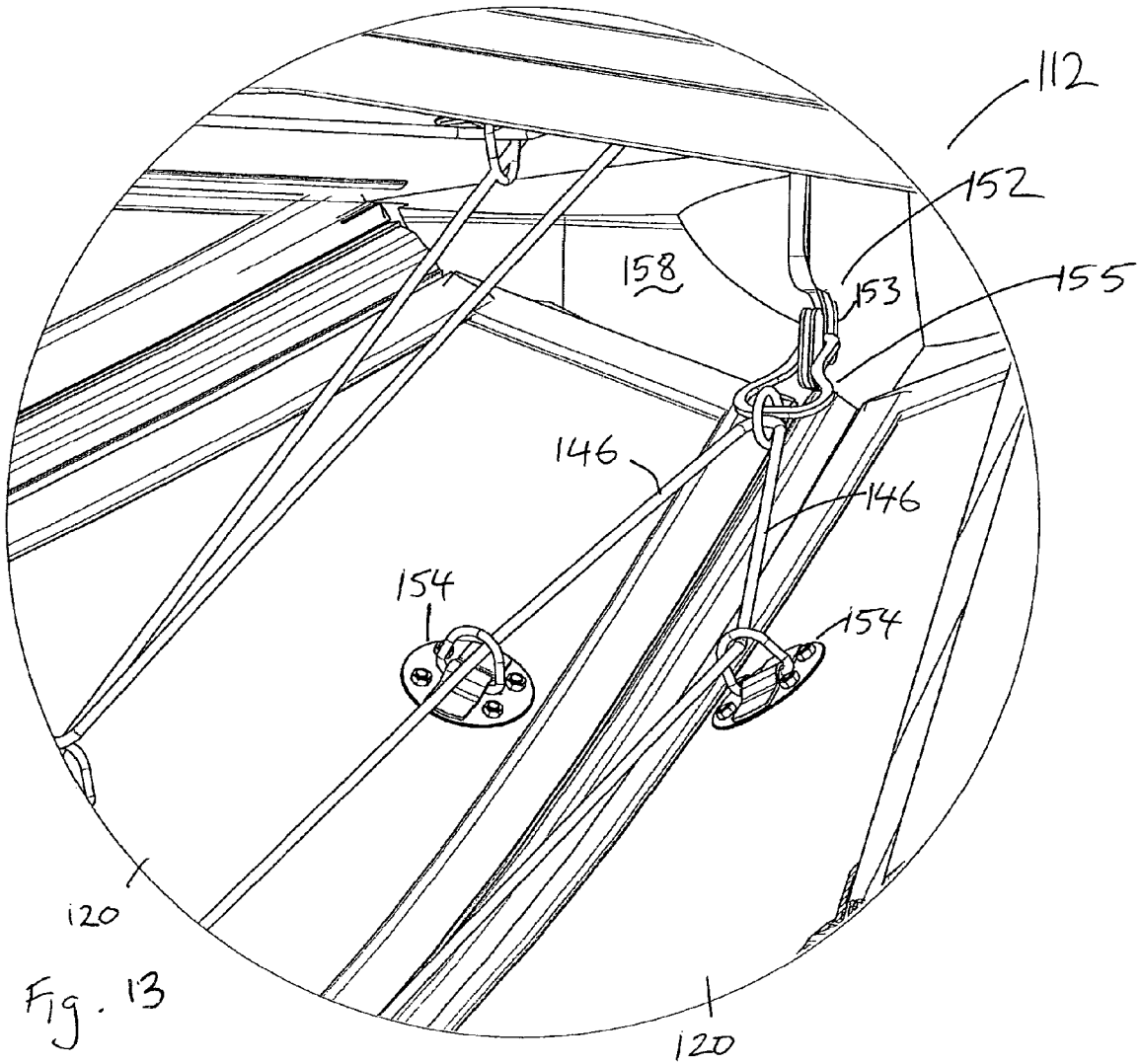
FIG. 13 is an enlarged cut away view of a portion of the bow of the boat of FIG. 11.

The bracing means at the bow 112 is in accordance with a further embodiment of the invention, and can be seen in FIGS. 11 to 13

The bow 112 includes a first member in the form of a cross bar 142. The cross bar 142 extends between the port panel 116 and the starboard panel 118, and is rigidly attached to each of the side panels 116, 118 using a releasable connection means. The bow also includes a composite second member comprising first cables 144, second cables 146 and a joining means 148.

In the embodiment of the drawings there are three first cables 144. Two first cables 144*a* extend downwardly from the cross bar 142 to the joining means 148. In practice the two first cables 144*a* are two halves of a single length of cable. The third first cable 144*b* extends from a removable bow cover 150 to the joining means 148.

Each of the two first cables 144*a* is connected to the cross bar 142 by a suitable receiving means. This may be releasable, or may represent a permanent connection.

In the embodiment of the drawings there is a single second cable 146. The second cable 146 forms a loop through an anchoring position 152, first brackets 154 on each bottom panel 120, and second brackets 156 on each bottom panel 120, and upwardly to the joining means 148.

As for the first cables 144*a*, the second cables 146 may be two separate lengths of rope or cable, one for each bottom panel 120.

The second bracket 156 acts as a receiving means on the bottom panel 120 for the second member.

The anchoring positions 152 are located at the bow 112. The collapsible boat 112 of the drawings has a collapsible, two piece nose cone 158 at the bow 112 which will be further described below. The anchoring positions 152 are located such that a tensile force applied to the positions 152—such as by a second cable 146 in tension—acts to pull the two pieces of the nose cone 158 together. This is best seen in FIG. 13. The nose cone 158 may be part of the bow cover 150.

The anchoring positions 152 cooperate to form a channel 153. The second cables 146 extend from a bracket 155 at their outer end, the bracket 155 being shaped to slot within the channel 153.

The joining means 148 of the embodiments of the drawings is a strap having a loop 160 at an upper end through which the first cables 144 can be secured and a hook 162 at a lower end which can accommodate the second cables 146. The strap includes a buckle 164 for adjustment and tightening.

In the embodiment of the drawings, the first cables 144 are relatively rigid, with the second cables 146 being flexible ropes. When the boat is assembled, tightening of the joining means 148 by use of the buckle 164 brings the first and second cables 144, 146 into tension. This has the effect of locking the nose cone 158 and bow cover 150 into position. It also has the effect of restraining movement of the bottom panels 120, in a similar fashion to the bracing of the stern 114 described above.

The efficacy of this arrangement in restraining movement of the bottom panels 120 is dependent to an extent on the geometry of the second cables 146. In some configurations, where the second cable 146 is a single loop as shown in the drawings it may be desirable to include means to restrict the sliding of the rope through the brackets 154, 156. The second brackets 156 and/or the first brackets 154 may also be moved away from the centre of the boat 110 towards the side panels 116, 118 in order to change the angle through which the tension on the cable 146 acts.

Figure 14A:
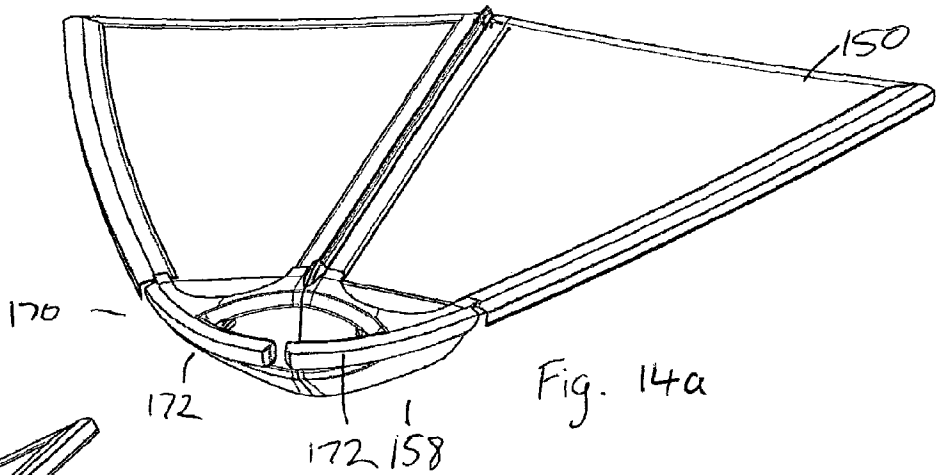
FIG. 14*a* is a perspective of a two-piece nose cone from the bow of the boat of FIG. 8 shown in an assembled configuration.
Figure 14B:
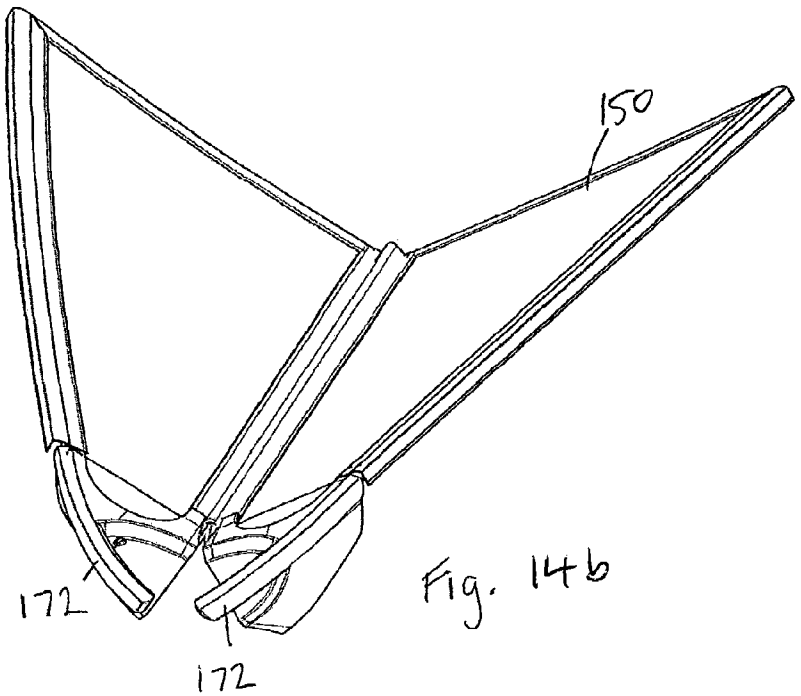
FIG. 14*b* is a perspective of the nose cone of FIG. 14*a* shown during collapsing.

The two piece nose cone 158 can be best seen in FIGS. 14*a* and 14*b*. The nose cone 158 is arranged to fit over the bow 112 of the boat 110 and to provide a splash-proof seal at the bow.

The nose cone 158 has a prow 170 formed by two resilient arms 172. The arms 172 are curved towards each other, to create a curved profile at the bow 112. The curved arms 172 can thus be used as a handle for the boat 110. Further, the resilient nature of the arms 172 means that they can serve as a 'bumper' for the boat 110, preventing damage to other boats during low-speed collision.

Outer ends of the arms 172 are slightly spaced from each other in an erected configuration. This gap can be used for running a rope or a chain, for instance connected to a sea anchor.

Modifications and variations as would be apparent to a skilled addressee are deemed to be within the scope of the present invention.

What is claimed is:

1. A collapsible boat hull comprising:

a pair of bottom panels, each bottom panel having a first continuous hinge along an inner edge thereof and a second continuous hinge along an outer edge thereof;

a pair of side panels, each side panel being connected to an adjacent bottom panel along a respective second continuous hinge;

a stern member;

a seat, the seat coupling the stern member to the side panels and providing a brace between the stern member and the side panels; and bracing means, the bracing means extending between the seat and at least one bottom panel, whereby the bracing means constrains movement of the bottom panel away from the seat.

2. An apparatus for bracing a collapsible boat, the boat having two sides and at least one bottom panel, the apparatus including a first member, the first member being a seat, which extends between one side of the boat and the other, and at least one second member, the at least one second member extending between a bottom panel and the first member, wherein the at least one second member restricts the movement of its associated bottom panel in a direction away from the at least one second member.

3. An apparatus for bracing a collapsible boat as claimed in claim 2, wherein the boat has at least two bottom panels and each bottom panel has a second member extending from the bottom panel to the first member.

4. An apparatus for bracing a collapsible boat as claimed in claim 2, wherein the first member has at least one longitudinal protrusion, the protrusion acting as a receiving means for the second member.

5. An apparatus for bracing a collapsible boat as claimed in claim 2 wherein the second member is rotatable about a receiving means on the bottom panel.

6. An apparatus for bracing a collapsible boat as claimed in claim 5 wherein the second member is of adjustable length, and is able to be brought into tension.

7. An apparatus for bracing a collapsible boat as claimed in claim 2, wherein the second member is a composite unit comprised of first cables extending downwardly from the first member and second cables extending upwardly from the bottom panels, the first and second cables being joined by a joining means.

8. An apparatus for bracing a collapsible boat as claimed in claim 7 wherein the joining means is adjustable to provide tension to the first and second cables.

9. An apparatus for bracing a collapsible boat as claimed in claim 7 wherein the boat has a two piece nose cone, and the act of tensioning the second cables brings the two pieces of the nose cone together.

10. An apparatus for bracing a collapsible boat the boat having two sides and at least one bottom panel, die apparatus including a first member which extends between one side of the boat and the other, and at least one second member, the at least one second member extending between a bottom panel and the first member, wherein the at least one second member restricts the movement of its associated bottom panel in at least one direction and is rotatable about a receiving means on the bottom panel.

11. An apparatus for bracing a collapsible boat as claimed in claim 10 wherein the second member is of adjustable length, and is able to be brought into tension.

12. An apparatus for bracing a collapsible boat, the boat having two sides and at least one bottom panel, the apparatus including a first member which extends between one side of the boat and the other, and at least one second member, the at least one second member extending between a bottom panel and the first member, wherein the at least one second member restricts the movement of its associated bottom panel in at least one direction and the second member is a composite unit comprised of first cables extending downwardly from the first member and second cables extending upwardly from the bottom panels, the first and second cables being joined by a joining means.

13. An apparatus for bracing a collapsible boat as claimed in claim 12 wherein the joining means is adjustable to provide tension to the first and second cables.

14. An apparatus for bracing a collapsible boat as claimed in claim 13 wherein the boat has a two piece nose cone, and the act of tensioning the second cables brings the two pieces of the nose cone together.

15. An apparatus for bracing a collapsible boat as claimed in claim 13 wherein the boat has a two piece nose cone, and the act of tensioning the second cables brings the two pieces of the nose cone together.

16. An apparatus for bracing a collapsible boat, the boat having two sides and at least one bottom panel, the apparatus including a first member which extends between one side of the boat and the other, and at least one second member, the at least one second member extending between a bottom panel and the first member, wherein the at least one second member restricts the movement of its associated bottom panel in a direction away from the at least one second, the second member being of adjustable length and able to be brought into tension.

* * * * *